US007500626B2

(12) United States Patent
Berger et al.

(10) Patent No.: US 7,500,626 B2
(45) Date of Patent: Mar. 10, 2009

(54) SWITCHING MECHANISM FOR A BATCH FEED WASTE DISPOSER

(75) Inventors: Thomas R. Berger, Racine, WI (US); Steven P. Hanson, Racine, WI (US)

(73) Assignee: Emerson Electric Co., St. Louis, MO (US)

( * ) Notice: Subject to any disclaimer, the term of this patent is extended or adjusted under 35 U.S.C. 154(b) by 0 days.

(21) Appl. No.: 11/750,480

(22) Filed: May 18, 2007

(65) Prior Publication Data

US 2007/0215726 A1 Sep. 20, 2007

Related U.S. Application Data

(63) Continuation of application No. 10/389,160, filed on Mar. 14, 2003, now abandoned.

(51) Int. Cl.
*B02C 19/00* (2006.01)

(52) U.S. Cl. ..... 241/32.5; 241/46.015; 241/46.016

(58) Field of Classification Search ..... 241/30, 241/32.5, 31, 101.1, 46.01–46.017
See application file for complete search history.

(56) References Cited

U.S. PATENT DOCUMENTS

| | | | | |
|---|---|---|---|---|
| 2,477,686 | A | 8/1949 | Coss | |
| 3,025,007 | A | 3/1962 | Wieczorek | |
| 3,374,958 | A | 3/1968 | Shive | |
| 3,409,234 | A * | 11/1968 | Smith | 241/32.5 |
| 3,425,637 | A * | 2/1969 | Enright et al. | 241/32.5 |
| 3,430,871 | A * | 3/1969 | Ross | 241/32.5 |
| 3,695,519 | A | 10/1972 | Bebinger | |
| 3,873,036 | A | 3/1975 | Smith | |
| 3,982,703 | A * | 9/1976 | Meyers | 241/46.015 |
| 4,124,789 | A | 11/1978 | Preece et al. | |
| 4,310,933 | A * | 1/1982 | Stratman | 241/46.015 |
| 4,409,234 | A | 10/1983 | Fujimura et al. | |
| 5,249,749 | A | 10/1993 | Krebsbach | |
| 6,082,643 | A | 7/2000 | Kovacs | |
| 6,261,515 | B1 | 7/2001 | Ren et al. | |
| 6,347,759 | B1 * | 2/2002 | Sedlak | 241/301 |
| 6,812,594 | B2 | 11/2004 | Face et al. | |

(Continued)

FOREIGN PATENT DOCUMENTS

GB 776320 6/1957

(Continued)

OTHER PUBLICATIONS

Exhibit A, Figures A1-A10.

(Continued)

*Primary Examiner*—Bena Miller
(74) *Attorney, Agent, or Firm*—Harness Dickey & Pierce, P.L.C.

(57) ABSTRACT

A switching mechanism for a food waste disposer is provided having a plastic one-piece housing that engages an external surface of the food waste disposer by snapping thereto. The switching mechanism also contains a switch capable of enabling operation of the food waste disposer in response to an interlock device positioned within the drain opening. Also provided is a method for converting a continuous feed waste disposer into a batch feed waste disposer. The switching mechanism includes a plug having a male end and a female end that can receive the electrical plug from the continuous feed waste disposer.

12 Claims, 7 Drawing Sheets

U.S. PATENT DOCUMENTS

| | | | |
|---|---|---|---|
| 2004/0178288 | A1 | 9/2004 | Berger et al. |
| 2004/0178289 | A1 | 9/2004 | Jara-Almonte et al. |
| 2004/0178299 | A1 | 9/2004 | Likosar |
| 2006/0038047 | A1 | 2/2006 | Anderson et al. |

FOREIGN PATENT DOCUMENTS

| | | |
|---|---|---|
| GB | 1153612 | 5/1969 |
| JP | 10-099707 | 4/1998 |
| JP | 11-010020 | 1/1999 |
| JP | 2001-029836 | 2/2001 |
| WO | WO-2004/082835 | 9/2004 |

OTHER PUBLICATIONS

Exhibit B, Figures B-1-B-9.
Exhibit C, Figure 1.

* cited by examiner

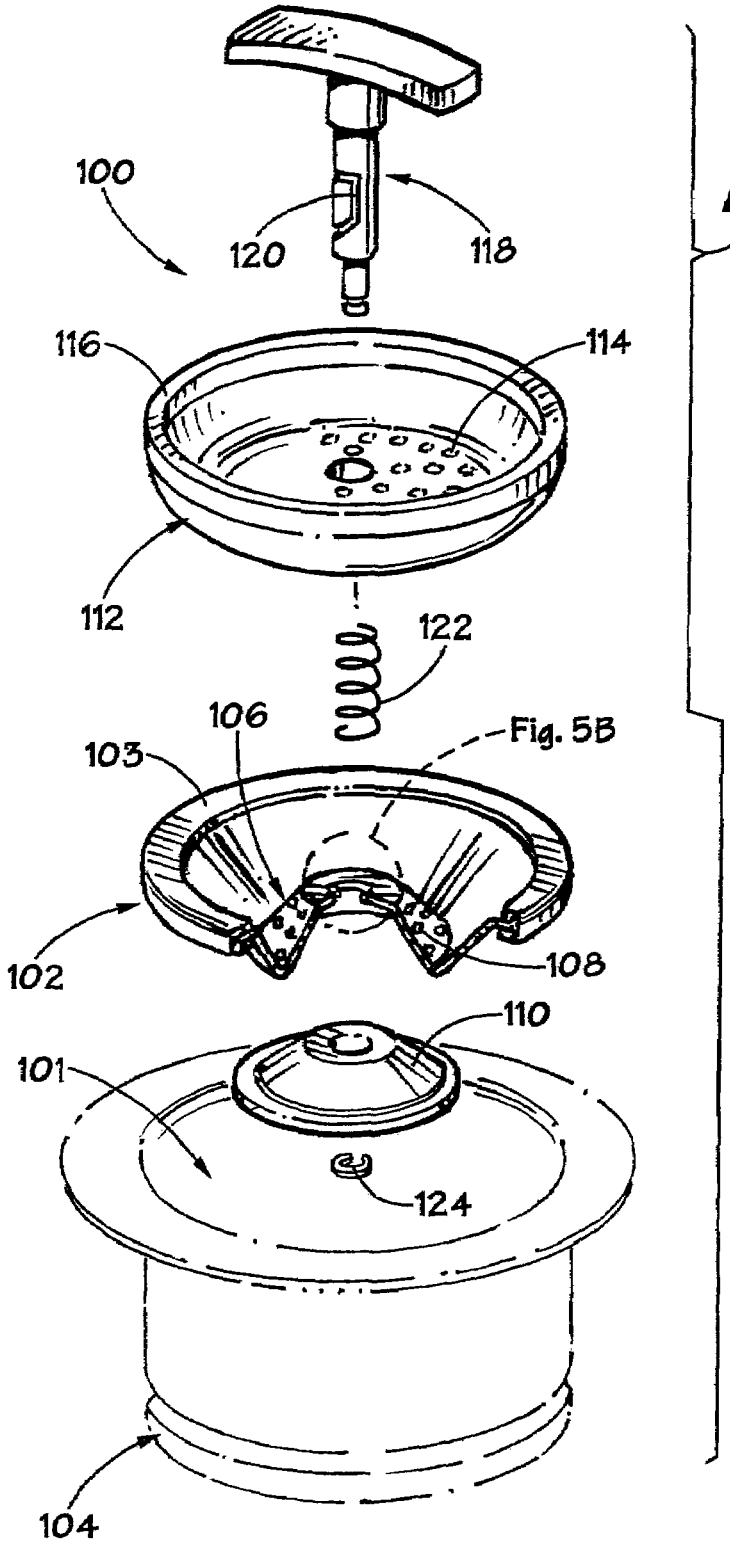
Fig.5A
Fig.5B
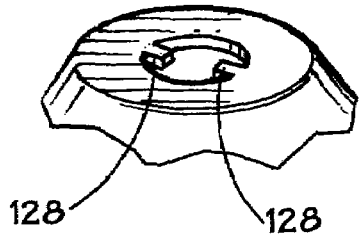

SWITCHING MECHANISM FOR A BATCH FEED WASTE DISPOSER

CROSS-REFERENCE TO RELATED APPLICATIONS

This application is a continuation of U.S. patent application Ser. No. 10/389,160 filed on Mar. 14, 2003. U.S. Ser. No. 10/389,160 is related to U.S. patent application Ser. No. 10/389,142 also filed on Mar. 14, 2003. The disclosures of these applications are incorporated by reference herein in their entireties.

FIELD OF THE INVENTION

This invention is directed to food waste disposers, and more specifically to means to operate food waste disposers in a batch feed mode.

BACKGROUND OF THE INVENTION

The present disclosure relates to a switching mechanism for use with batch feed waste disposers.

As opposed to continuous feed waste disposers, batch feed waste disposers operate by filling the disposer with waste food, then substantially blocking the drain opening prior to operating the disposer, thereby disposing of food waste in batches. A batch feed disposer uses an interlock device positioned in the drain opening to activate the disposer. The interlock device also prevents foreign objects, such as silverware, from entering the disposer during operation, but will typically allow water to flow into the disposer. Batch feed waste disposers are also used in kitchens that do not have an electrically wired switch above the sink area, in which case the interlock device acts as the switch for the batch feed waste disposer.

One common means for activating the disposer is through mechanical contact of the interlock device with a switch in the throat of the disposer. However, such mechanical means of activating the disposer have been unreliable and subject to premature failure.

Newer methods for activating a batch feed waste disposer have included non-contact approaches, such as activation of a magnetic switch for example. In this approach, the interlock device contains a magnet which, when properly aligned within the drain opening, closes a magnetic switch that activates the disposer. The interlock device must be positioned such that its magnet is in the correct vertical and radial position within the drain opening to align with the magnetic switch.

An interlock device must also be capable of remaining in position throughout the operation of the disposer while allowing the free flow of water into the disposer. However, when the disposer is not in use, it is desirable that the homeowner be able to retain water in the sink using a stopper without activating the disposer, such as for dishwashing. Previous disposers with magnetic interlocks have used two different devices to perform these two different functions—an interlock device for activation of the disposer with water flow, and a stopper device for water retention without disposer activation. What is needed is a single device that can perform both functions, thereby reducing the number of accessory parts for the disposer and sink and simplifying their use.

In batch feed waste disposers using magnetic switch assemblies, such as those marketed by Viking Range Corporation of Greenwood, Miss., a magnet connected to a switch, typically a snap action switch or microswitch, is used to activate the disposer. Additionally, a reed switch or Hall-Effect sensor can also be used. The assembly is typically mounted onto an exterior surface of the disposer body using a special connection assembly. What is needed is a simple magnetic switch assembly that can be easily installed on an existing food waste disposer by a homeowner without the use of tools. It is also desirable to have a magnetic switch assembly that can be easily installed onto an existing continuous feed waste disposer in order to convert the continuous feed waste disposer into a batch feed waste disposer.

SUMMARY OF THE INVENTION

A switching mechanism for a food waste disposer is provided having a plastic one-piece housing that engages an external surface of the food waste disposer by snapping thereto. The switching mechanism also contains a switch capable of enabling operation of the food waste disposer in response to an interlock device positioned within the drain opening. Preferably, a snap action switch coupled to a rare earth magnet activates the food waste disposer when the rare earth magnet is either attracted or repelled by a magnet coupled to an interlock device. In a preferred embodiment, the housing is engaged with a sink flange coupled to a plurality of flange screws, and the housing secures its position by locking onto at least one of the flange screws.

Also provided is a method for converting a continuous feed waste disposer into a batch feed waste disposer. The switching mechanism includes a plug having a male end and a female end that can receive the electrical plug from the continuous feed waste disposer. By engaging the switching mechanism with an external surface of the continuous feed waste disposer as described herein, plugging the male end of the switching mechanism plug into an electrical outlet, and plugging the male end of the continuous feed waste disposer plug into the female end of the switching mechanism, the continuous feed waste disposer is converted into a batch feed waste disposer that can be activated only by closing the switch in the switching mechanism.

BRIEF DESCRIPTION OF THE DRAWINGS

A more complete understanding of the present disclosure may be obtained with reference to the accompanying drawings:

FIG. 5A shows an exploded perspective view of a first embodiment of an interlock device in accordance with certain teachings of the present disclosure.

FIG. 5B shows a cut-away of the lower disk of the first embodiment of the interlock device depicted in FIG. 4A.

DESCRIPTION OF ILLUSTRATIVE EMBODIMENTS

The present disclosure will now be described more fully with reference to the accompanying drawings in which preferred embodiments of the disclosed subject matter are shown. This disclosed subject matter may, however, be embodied in many other different forms and should not be construed as being limited to the embodiments set forth herein.

Referring to FIGS. 1-4, a magnetic switching assembly 10 that attaches to a sink flange 20 is shown. A discussion of sink flanges as well as standard sink mounts for food waste disposers can be found in U.S. Pat. No. 3,025,007, which is incorporated by reference herein.

Figure 1:
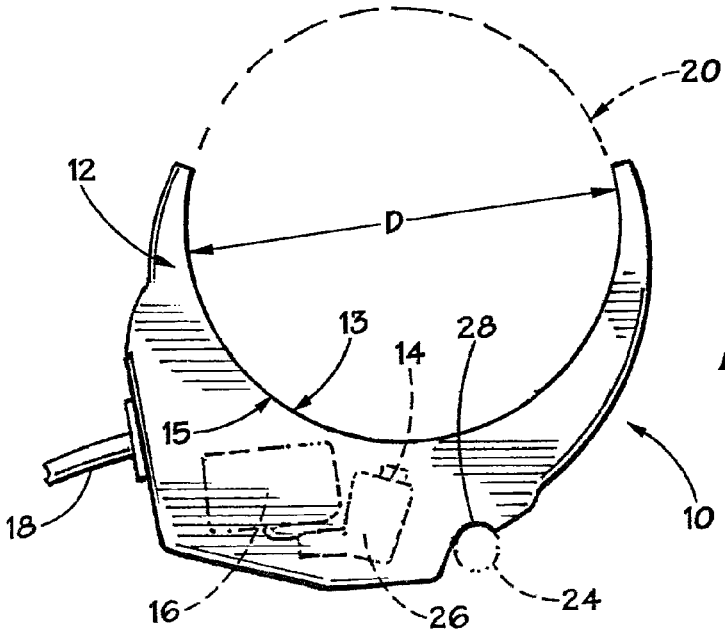
FIG. 1 shows a top view of a switching assembly in accordance with certain teachings of the present disclosure.

FIG. 1 depicts a top view of magnetic switch assembly 10, which consists of a housing 12, a magnet 14 (contained within the housing, shown in phantom), and a switch 16 (contained within the housing, shown in phantom) operatively coupled to magnet 14. Switch 16 ultimately connects to and controls the power supply (not shown) that operates the disposer through cable 18. Housing 12 is a one-piece housing made of a plastic material or any other suitable material. The term "one-piece housing" denotes the final structure of housing 12 as used by a homeowner, and it is envisioned that housing 12 may in fact be constructed of two or more pieces.

Figure 2:
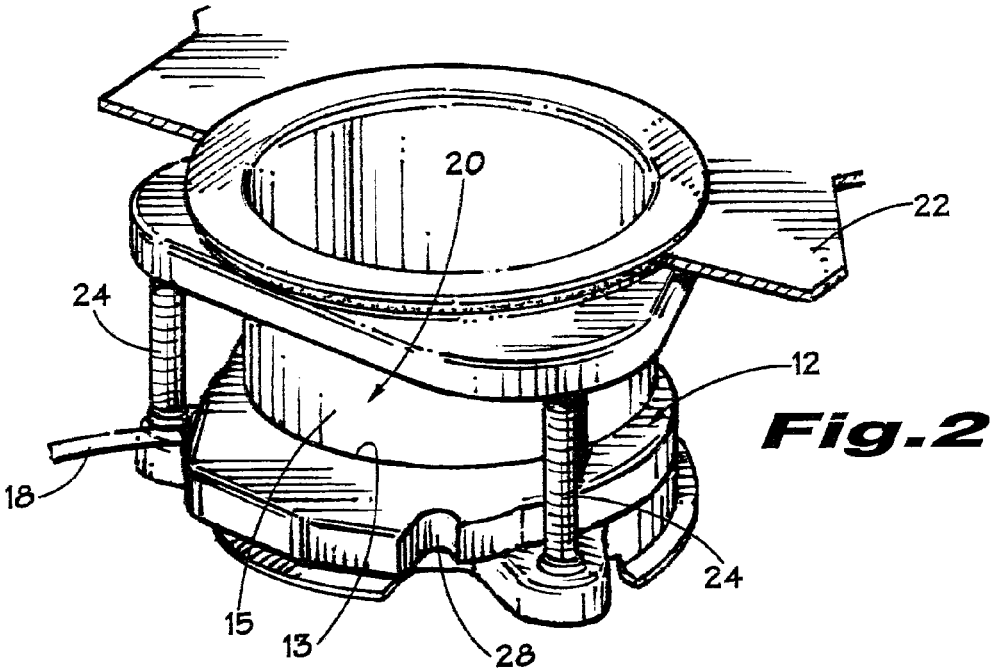
FIG. 2 shows a perspective view of a switching assembly snapped around a sink flange in accordance with certain teachings of the present disclosure.
Figure 3:
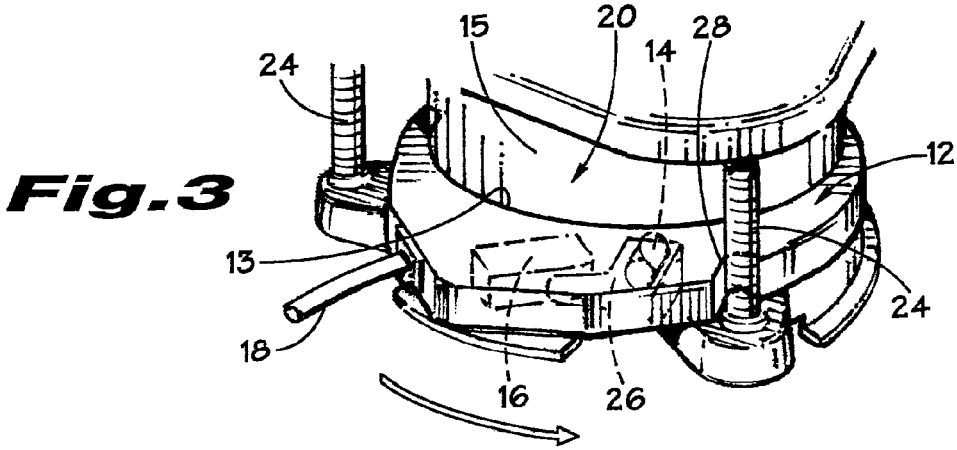
FIG. 3 shows a perspective view of the switching assembly of FIG. 2 secured by a flange screw.

It is a preferred aspect of the present disclosure that housing 12 is attached to the sink flange 20 by "snapping" housing 12 around at least a portion of the exterior periphery of sink flange 20. It is also envisioned that housing 12 may be snapped onto any exterior surface 15 of the food waste disposer circumscribing the drain opening. As best shown in FIG. 1, this snapping engagement is accomplished by providing a housing 12 that matches the approximate diameter D of sink flange 20. In this manner, a first surface 13 of housing 12 engages the external surface 15 of sink flange 20 of the disposer. As best shown in FIG. 3, this first surface 13 and the external surface 15 are generally circular in geometry. Note also that it is preferred that housing 12 encompasses greater than half of the circumference of sink flange 20 so as to promote steady engagement of housing 12 to sink flange 20 while still allowing a snap fit. As best shown in FIG. 2, housing 12 snaps around sink flange 20 and remains fittingly engaged with sink flange 20 without requiring any disassembly of sink 22, sink flange 20, or the food waste disposer (not shown). In particular, housing 12 attaches to sink flange 20 in between two of the (typically) three flange screws 24. Thus, housing 12 can be installed or removed without removing any of the flange screws 24.

Housing 12 also preferably contains a locking groove 28 that is designed to engage at least one of the flange screws. Thus, magnetic switching assembly 10 can be securely installed by first snapping housing 12 around sink flange 20 (FIG. 2), then rotating housing 12 until locking groove 28 engages a flange screw 24. Securing the magnetic switching assembly 10 in this manner reduces the likelihood of the magnetic switching assembly 10 moving during operation of the food waste disposer and provides a consistent switching location.

One of skill in the art will realize that the proper position of housing 12 on sink flange 20 (i.e. the relative vertical distance below sink 22) is dependent upon the expected location of the activating magnet when the interlock device is positioned in the drain opening. Such a person skilled in the art will be able to adjust the position of the housing accordingly.

Housing 12 is designed to hold magnet 14, switch 16, and any other coupling devices 26 necessary to operatively couple magnet 14 to switch 16. Although FIGS. 1-4 illustrate housing 12 as completely containing magnet 14 and switch 16, it is feasible that the housing only partially contains one or both of these items. Although a single switch is depicted in the figures and described herein, one of skill in the art should appreciate that a plurality of switches may be used to provide a redundant switching system (e.g. a switching mechanism in which two switches must be closed in order to activate the food waste disposer). Another functional aspect of housing 12 is the steady positioning of magnet 14 at a location proximate to the exterior surface of sink flange 20. One of skill in the art will appreciate that this may be accomplished in several ways, one of which is depicted in FIG. 1 and FIG. 3.

As noted, switch 16 is designed to enable the operation of the food waste disposer upon sensing the presence of an interlock device having a magnet within the drain opening. Switch 16 is preferably a snap action switch coupled to a magnet 14, although it is envisioned that other types of receivers may be utilized for sensing the presence of the interlock device and its magnet. One skilled in the art should appreciate that the need for a separate magnet 14 within the switching assembly 10 is dependent upon the type of switch used. In the embodiments shown in FIGS. 1-3, a snap action switch 16 is used, and is coupled to magnet 14 as a means for sensing the interlock device's magnet and thereby closing the switch. However, the use of a reed switch or a Hall-Effect sensor as the receiver would not require a separate magnet in the housing. Inside a reed switch, two ferromagnetic contacts are either attracted or repelled in the presence of a magnetic field generated by the presence of a separate magnet, in this case the magnet located within an interlock device. The core of a Hall-Effect sensor is a Hall-Effect element. When a magnet is in the vicinity of the Hall-Effect element, a current flows within the element proportional to the strength of the field. The current produced in the element creates a potential difference between the two terminals. In a Hall-Effect switch, once this potential difference goes above a certain level, the switch then closes.

A snap action switch is preferred because it can handle the high running currents of a food waste disposer, which other types of switches may not be able to handle. Examples of snap action switches commonly found today on the market include the Cherry KWSA-0001 snap action switch and the Saia-Burgess snap action switch. Other switches, such as the reed switch or the Hall-Effect switch, may need to be used in combination with a relay or triac to allow high current operation. When the disposer is not in operation, switch 16 will be in the normally open configuration, meaning that the switch contacts are in the open-circuit position (i.e. the disposer is not activated).

There are two acceptable design alternatives for closing switch 16, both of which may be used to activate the food waste disposer. First, switch 16 may be closed when 11 magnet 14 is "attracted" by another magnet located inside the sink flange 20. Second, switch 16 may be closed when magnet 14 is "repelled" by another magnet located inside the sink flange 20. As is known, the disclosed snap action switches contain buttons which when pressed will cause the switch to be closed. It may be necessary (depending on the type of snap action switch used) to couple the movement of magnet 14 in the housing to the button on the switch 16. Accordingly, a coupling means 26, which is specially fitted to receive magnet 14 and to interface with the switch's 16 button, is designed to move as the magnet 14 moves, and accordingly to close the switch. Coupling means 26 is in one embodiment a specially formed and shaped piece of hard plastic, but could be made from several different materials and in several different configurations to effectuate proper transfer of the magnet force to the switch 16. However, depending on the orientation of the magnet and the switch, a coupling means 26 may not be necessary, so long as the magnet's force can be imparted directly to the switch. Moreover, a combined magnet/switch assembly can be used in lieu of components 14, 16, and 26, in which case the magnet on the assembly operates as the switch and directly controls the switching function.

Magnet 14 is preferably a rare earth magnet, and more preferably a magnet comprised of neodymium, and even more preferably a magnet comprised of neodymium iron boron. Rare earth magnets are preferred because of their strength, small size, reliability, and cost. Testing also reveals that rare earth magnets provide a more robust and accurate switching location, which is important for ease of use by homeowners.

Figure 4A:
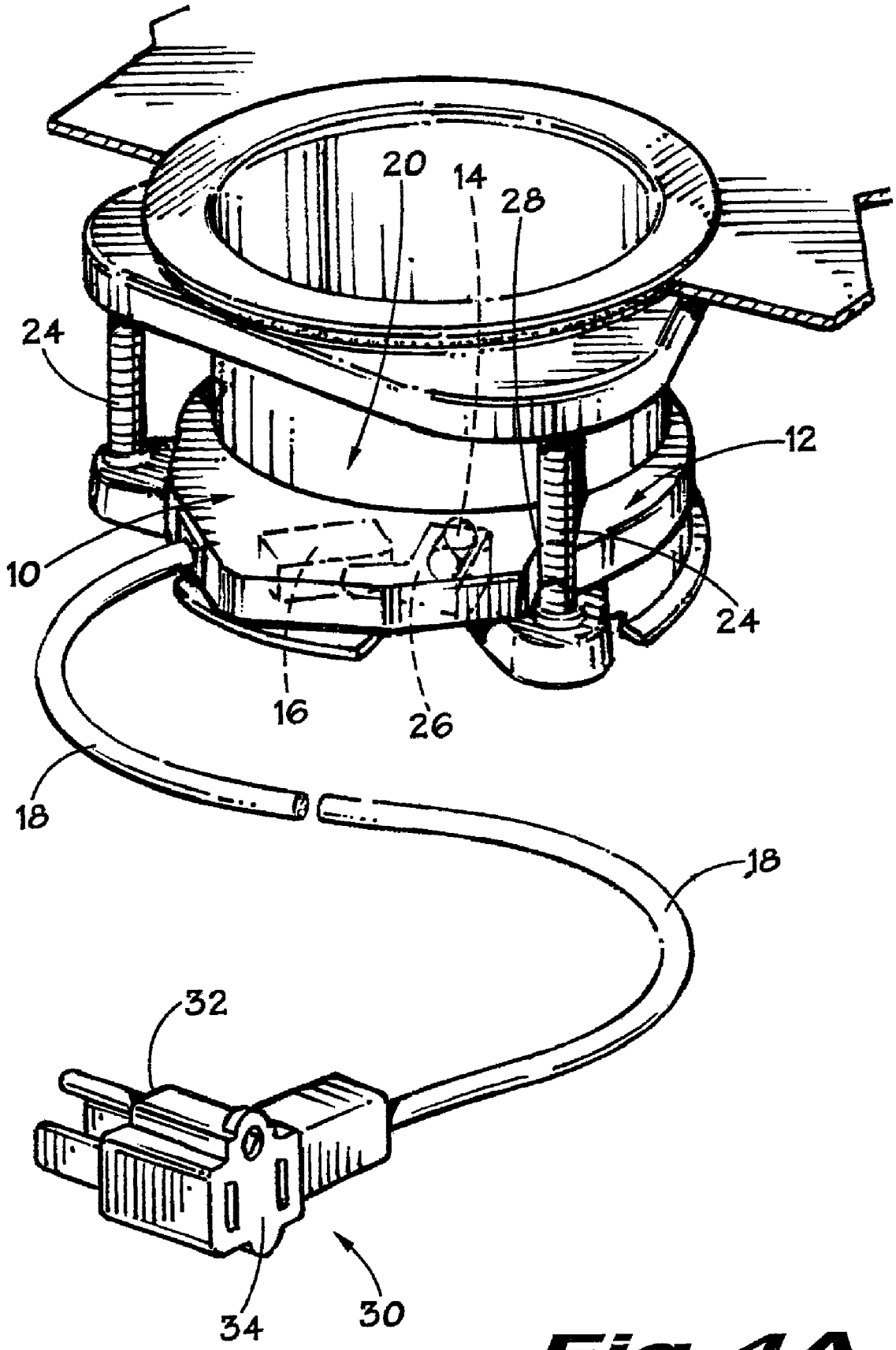
FIG. 4A shows a perspective view of the switching assembly including a plug for quick installation of the switching assembly.
Figure 4B:
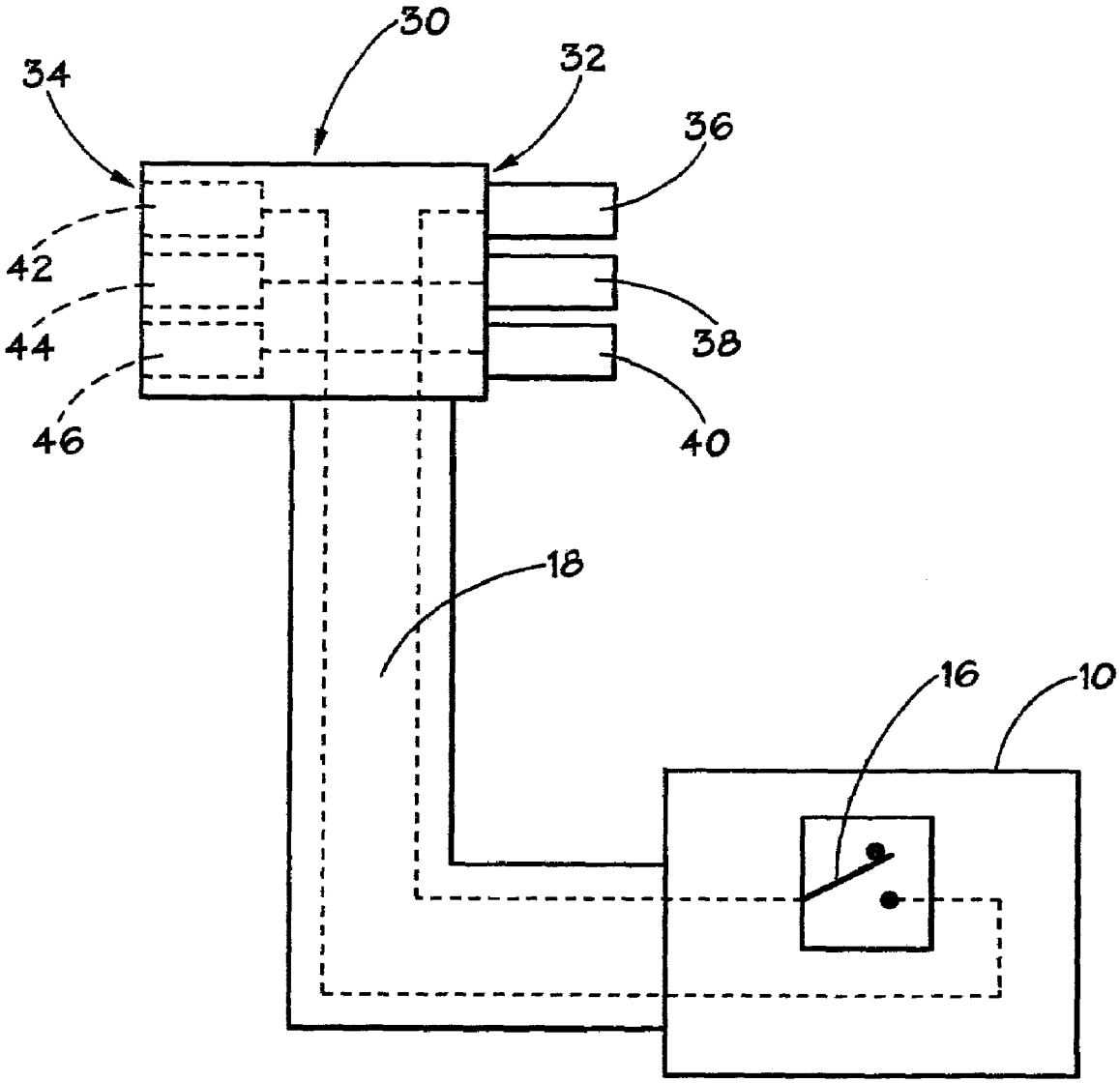
FIG. 4B shows a schematic diagram of the plug of FIG. 4A.

FIGS. 4A and 4B show an additional feature of the present disclosure. Although cable 18 may be connected directly to the food waste disposer, cable 18 may also be connected to plug 30 which may be plugged into a standard grounded electrical outlet. Plug 30 contains a male end 32 and a female end 34. As is well known in the art, male end 32 comprises three terminals, line terminal 36, neutral terminal 38, and ground terminal 40. Female end 34 has a line receptacle 42, a neutral receptacle 44, and a ground receptacle 46 for receiving a plug from a food waste disposer (not shown). As is shown in FIG. 4B, the food waste disposer can only be activated when the circuit connecting the line terminal 36 with line terminal 42 is closed by closing switch 16 of switching assembly 10. This design is especially useful for converting a continuous feed waste disposer into a batch feed waste disposer as it does not require any wiring on the part of the homeowner.

Figure 6:
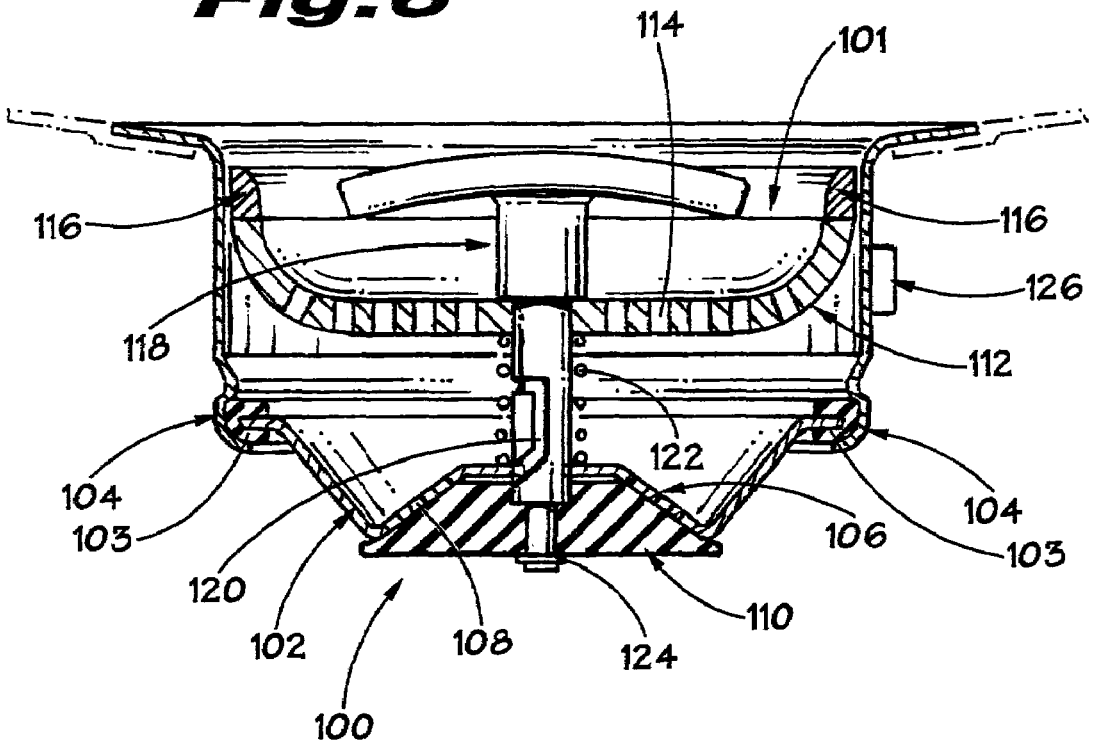
FIG. 6 shows a cross-sectional view of the first embodiment of an interlock device in the closed position.
Figure 7:
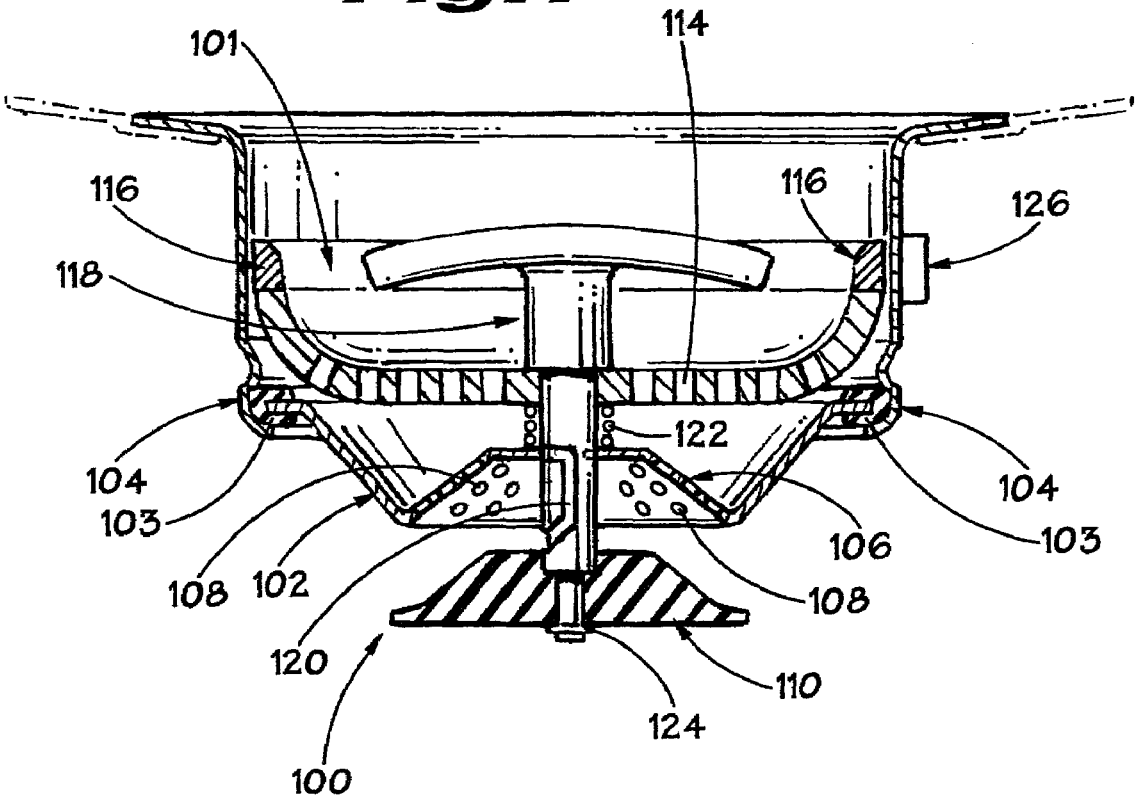
FIG. 7 shows a cross-sectional view of the first embodiment of an interlock device in the open position.

Turning now to FIGS. 5-7, a first embodiment of an interlock device 100 is shown in relation to drain opening 101. A lower disk 102 incorporates a seal 103 on the circumference of its upper edge for sealing with the strainer flange 104 of the food waste disposer. The lower disk 102 is designed with a conical section 106 having holes 108 that allow water flow when rubber seal 110 is in the open position. Rubber seal 110 is preferably a solid conical rubber part that mates with the conical section 106 of the lower disk 102 when in the closed position, thereby preventing water from flowing though the holes 108.

The interlock device 100 uses a movable strainer basket 112 that has drain holes 114 for the passage of water, and a magnet band 116 on the circumference of its upper edge. The strainer basket 112 is movable downward through a twist-and-lock motion of the stem 118. The track 120 on the stem 118 meets with tabs 128 (see FIG. 5B) located at the top of the conical section 106 to guide the twist and lock motion of the strainer basket 112 when moving from the closed to the open position and vice versa. A spring 122 fits over stem 118 between the strainer basket 112 and the lower disk 102, tending to bias the parts away from each other. Retaining ring 124 attaches to the bottom of stem 118 to secure the rubber seal 110 to stem 118. Alternatively, other retaining means may be employed, including but not limited to a retaining pin, adhesive means, threaded connection between stem 118 and rubber seal 110, or a pressing connection between stem 118 and rubber seal 110.

In FIG. 6 the interlock device 100 is shown in the closed position. In the closed position, rubber seal 110 is engaged with the conical section 106 of the lower disk 102. The inner surface of the housing of the switching mechanism and the outer surface of the food waste disposer system has a generally circular geometry with approximately equal diameters. Also in the closed position, magnet band 116 is above the switching position necessary to close the switch 126 (i.e., switch 16 of FIGS. 1-4), and thus is unable to activate the food waste disposer. Accordingly, water can pass through holes 114 in the strainer basket 112, but is prevented from flowing through the holes 108 in lower disk 102 because of the engagement of rubber seal 110. Therefore, when closed, the interlock device 100 acts as a stopper for the sink without activating the batch food waste disposer.

In FIG. 7 the interlock device 100 is shown in the open position. Interlock device 100 is moved from the closed position to the open position by pushing downward on the spring loaded stem 118. Tabs 128 (FIG. 5B) on the lower disk 102 follow track 120 upward as stem 118 is pushed downward. When tabs 128 reach the top of track 118, the stem can then be turned to lock tabs 128 in the horizontal portion of track 120.

In this open position, magnet band 116 is aligned with switch 126, thereby closing switch 126 and activating the food waste disposer. Note that because magnet band 116 covers the circumference of strainer basket 112, radial alignment of the magnet band 116 with the switch 126 is not an issue with this embodiment. However, it is possible that magnet band 116 could be replaced with a smaller magnet located at one position along the upper edge of strainer basket 112. In this alternative embodiment, it would be necessary to radially align this smaller magnet with switch 126, which could constitute an important additional feature. In the open position, drain holes (108, 114) on both the lower disk 102 and the strainer basket 112 are open for water to drain into the disposer, which is desirable during the operation of the disposer.

Reversing the twisting motion described above, in conjunction with the bias of spring 122, returns strainer basket 112 and rubber seal 110 to the closed position;, thereby deactivating the food waste disposer. As is evident, removing interlock device 100 from the drain opening would allow water flow through the drain opening without disposer is activation.

Turning now to FIGS. 8-11, a second embodiment of an interlock device 200 is shown in relation to drain opening 201. Interlock device 200 is preferably a one-piece unit having no movable components. The interlock device 200 has two opposing ends: a first end 202 having a diameter D.sub.1 and a second end 204 having an effective diameter D.sub.2, where D.sub.2 is greater than D.sub.1. The second end may be circular in shape, or may be non-circular as shown in FIGS. 8-11. In this regard, the "effective" diameter D.sub.2 constitutes the diameter of a circle circumscribed about the non-circular second end 204. Each end provides a different functionality for stopper 200. In this embodiment, a magnet 208 is positioned at the outer periphery 210 of the second end 204. Orienting stopper 200 such that a particular end is placed into drain opening 201 dictates the operability of the food waste disposer. Additionally, each end (202, 204) may contain a handle 206 formed within that side to facilitate handling by the homeowner.

Figure 9A:
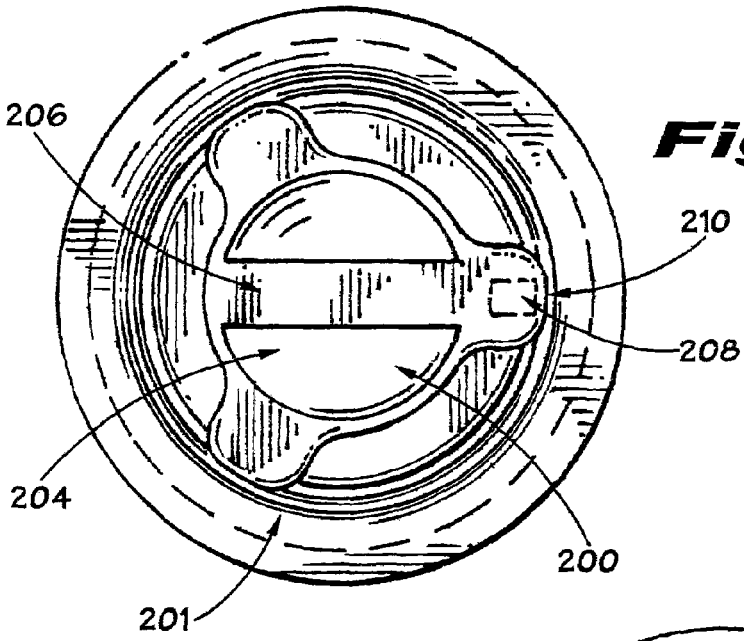
FIG. 9A shows a top view of the second embodiment of an interlock device in relation to a drain opening in the closed position.
Figure 11:
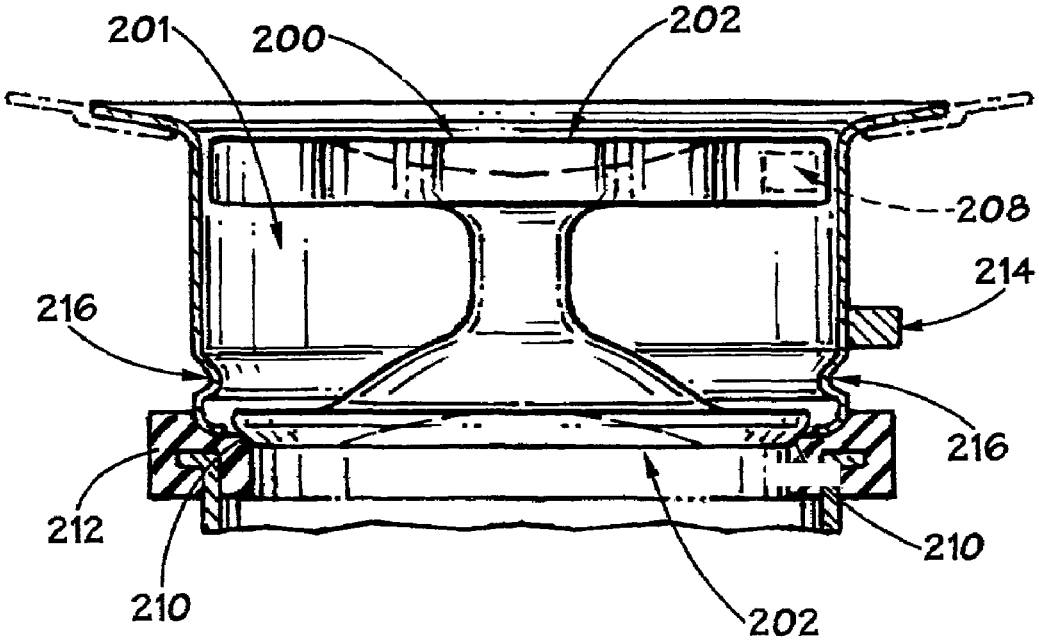
FIG. 11 shows a side cross-sectional view of the second embodiment of an interlock device in relation to a drain opening in the closed position.

FIG. 9A and FIG. 11 show interlock device 200 in relation to drain opening 201 in the closed position. First end 202 is inserted downward into drain opening 201 and seats with the existing mounting gasket 212 (as shown in FIG. 11), such that a primary sealing surface 210 is formed, thereby blocking the flow of water through drain opening 201. Other alternative surfaces within drain opening 201, such as the upper face of an existing removable baffle (not shown), would also be sufficient to provide an effective sealing surface provided that magnet 208 does not align with switch 214. In this configuration, interlock device 200 acts as a stopper for the sink and, because magnet 208 is not aligned with switch 214, the batch food waste disposer is not activated.

Figure 9B:
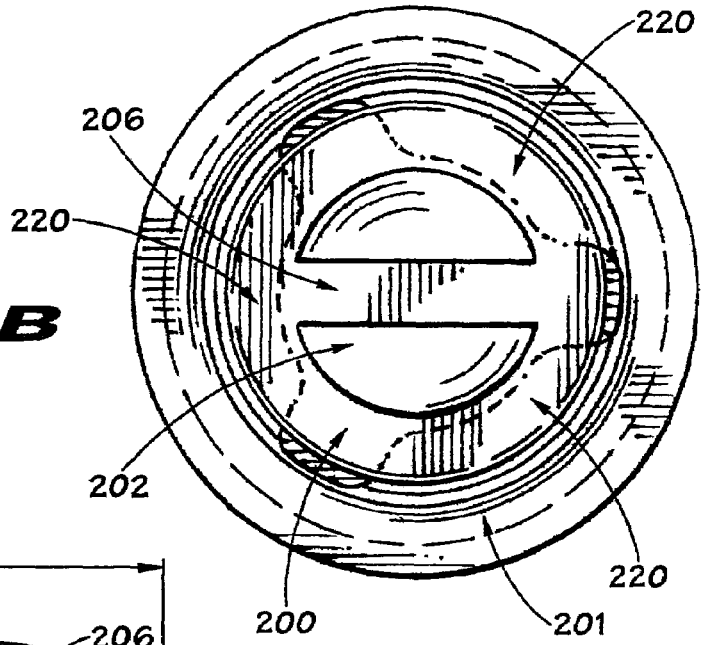
FIG. 9B shows a top view of the second embodiment of an interlock device in relation to a drain opening in the open position.
Figure 10:
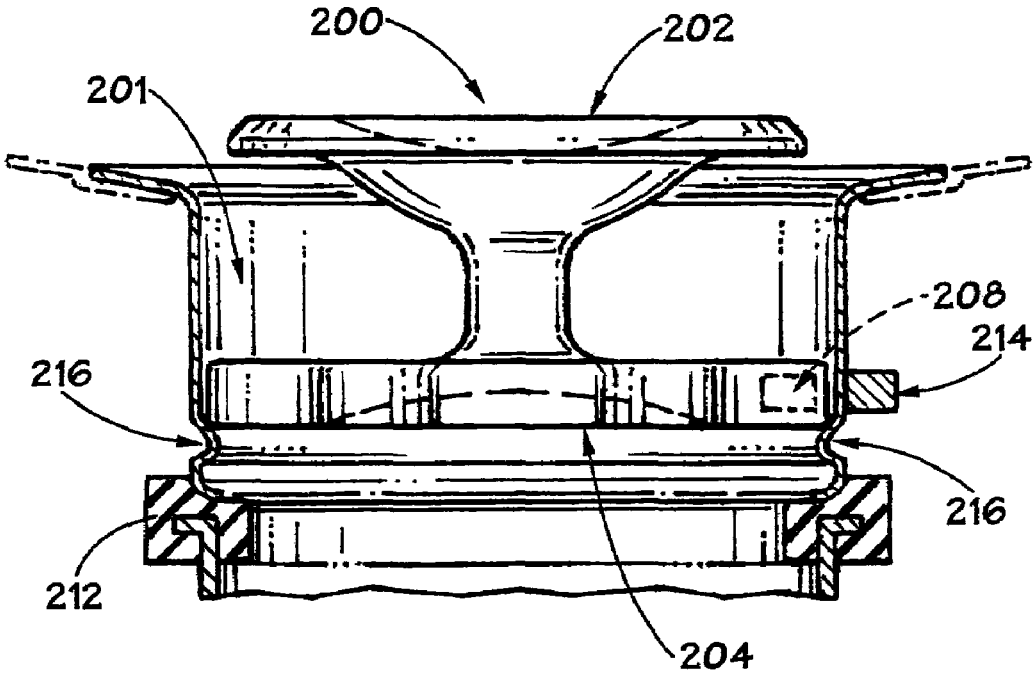
FIG. 10 shows a side cross-sectional view of the second embodiment of an interlock device in relation to a drain opening in the open position.

FIG. 9B and FIG. 10 illustrate the open position for interlock device 200. When the second side 204 is inserted downward into drain opening 201, the second side rests on annular ridge 216, which is—preferably of a diameter between D.sub.1 and D.sub.2 (and hence would allow end 202, but not end 204, to pass). In this position, magnet 208 is aligned with switch 214 (i.e., switch 16 of FIGS. 1-4) located outside the sink flange, thereby activating the food waste disposer. Note that the location of annular ridge 216 provides the proper vertical alignment with switch 214. However, the interlock device 200 may seat on other surfaces, including the mounting gasket (not shown) or an existing removable baffle (not shown), provided that magnet 208 is aligned with switch 214 and water is allowed to freely flow into the disposer.

Although second end 204 is shown in this embodiment as having a "three-spoked" design, it should be apparent to one of skill in the art that other shapes could be used provided that the surface seats within drain opening 201 in such a way that the food waste disposer is activated and water is allowed to flow into the disposer. In the embodiment of FIGS. 8-11, the second side 204 has a non-circular geometric face that inherently provides spaces 220 for water to flow through drain opening 201 when seated in this configuration, and therefore water freely flows into the disposer, which is desirable during operation of the disposer. Alternatively, providing an interlock device 200 with a second end that is circular would require some form of drain openings (i.e. holes, slits) that can allow water to freely flow into the disposer when the disposer is activated.

Figure 8:
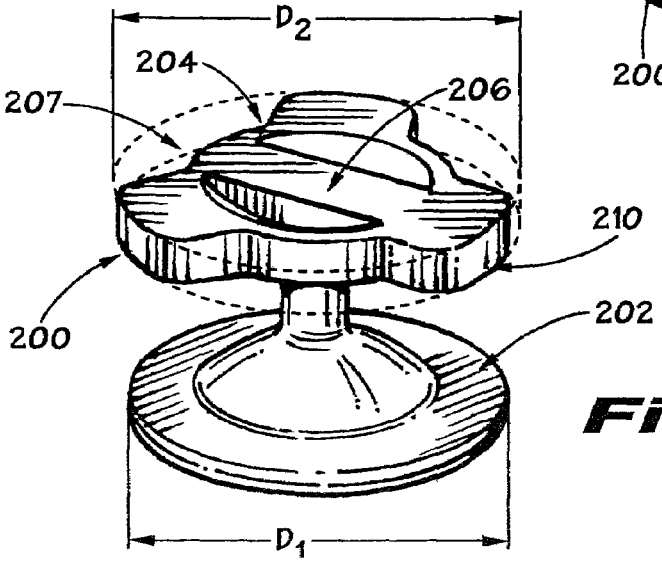
FIG. 8 shows a perspective view of a second embodiment of an interlock device in accordance with certain teachings of the present disclosure.

Furthermore, although this embodiment shows a single magnet 208 located within one "spoke" on second end 204, one skilled in the art should appreciate that any number of magnets may be placed at any number of locations along the periphery of second end 204 so as to realize the advantages described herein. Another alternative embodiment of the magnet is a magnetic band 207, as shown in phantom in FIG. 8, which may be employed in conjunction with the second end 204 to eliminate the need to radially align the second end 204 with the switch 214 while still allowing water to flow through to the disposer. Note that a magnetic band 207 may be employed with a second end that is circular in geometry or non-circular in geometry as is shown in FIG. 8. A plurality of magnets along the periphery of the second end 204 provides yet another option for disposer engagement since a switching mechanism may be designed with a plurality of redundant switches that must be aligned simultaneously with a plurality of magnets in an interlock device in order to activate the disposer. Arrows may be provided either on the first or second end and on the drain opening 201 to guide the user in aligning magnet 208 with switch 214 if such alignment is necessary in a given embodiment.

Interlock device 200 is preferably constructed at least partially of a plastic material, but one skilled in the art should appreciate that any other suitable material, such as a rubber or non-magnetic metal material for example, may be used.

It will be apparent to one of skill in the art that described herein is a novel system for activating a batch feed waste disposer. While the invention has been described with reference to specific embodiments, it is not limited to these embodiments. The invention may be modified or varied in many ways and such modifications and variations are within the scope and spirit of the invention and are included within the scope of the following claims.

What is claimed is:

1. A switching mechanism for a food waste disposer system having a food waste disposer coupled to a sink by a sink flange, the switching mechanism comprising:

a housing attachable to the food waste disposer system with an inner surface of the housing extending around a portion of an outer surface of the food waste disposer system that circumscribes a drain opening through which the sink drains, the inner surface of the housing and the outer surface of the food waste disposer system having a generally circular geometry, the inner surface having a diameter approximately equal to a diameter of the outer surface; and the housing having a magnetically actuated switch disposed therein that enables the food waste disposer in response to being actuated by a magnet of an interlock device positioned in the drain opening.

2. The apparatus of claim 1 wherein an outer surface of the sink flange comprises the outer surface around which the housing extends.

3. The apparatus of claim 2 wherein the housing includes a locking groove that engages a flange screw that attaches the sink flange to the sink.

4. The apparatus of claim 2 wherein the housing is disposed between two of three flange screws that attach the sink flange to the sink when the housing is attached to the food waste disposer system.

5. The apparatus of claim 4 wherein the housing includes a locking groove that engages at least one of the flange screws.

6. The apparatus of claim 2 wherein the housing is attachable to the food waste disposer system by snapping engagement.

7. The apparatus of claim 1 wherein the housing is removably attachable to the food waste disposer system.

8. The apparatus of claim 1 wherein the magnetically actuated switch includes a receiver that detects the presence of the magnet of the interlock device.

9. The apparatus of claim 8 wherein the receiver includes at least one of a reed switch, a Hall-Effect device or a second magnet.

10. The apparatus of claim 1 including a router plug coupled to the switch, the router plug including a male end receivable by an electrical outlet and a female end for receiving an electrical plug of the food waste disposer, wherein the router plug routes power from the electrical outlet to the food waste disposer through the switch.

11. The apparatus of claim 1 wherein the magnet of the interlock device includes a plurality of magnets, and the switch is actuable only upon simultaneous alignment of the plurality of magnets of the interlock device with the switching mechanism.

12. The apparatus of claim 11 wherein the switch includes a plurality of magnetically actuated switches that must be aligned simultaneously with the plurality of magnets of the interlock device to enable the food waste disposer.

* * * * *